US006003458A

United States Patent [19]

Valliere

[11] Patent Number: 6,003,458

[45] Date of Patent: Dec. 21, 1999

[54] EXPANDABLE PONTOON BOAT

[76] Inventor: Michael R. Valliere, 3318 Hwy. 42, Hattiesburg, Miss. 39402

[21] Appl. No.: 09/251,625

[22] Filed: Feb. 17, 1999

[51] Int. Cl.[6] ..... B63B 1/00

[52] U.S. Cl. ..... 114/61.18; 114/61.15

[58] Field of Search ..... 114/61.15, 61.18, 114/61.1, 61.22, 344, 123

[56] References Cited

U.S. PATENT DOCUMENTS

| | | | |
|---|---|---|---|
| 1,710,625 | 4/1929 | Kapigian | 114/123 |
| 3,045,263 | 7/1962 | Blachly | 9/1 |
| 3,114,157 | 12/1963 | Stockman | 9/11 |
| 3,925,837 | 12/1975 | Miller | 9/2 R |
| 3,981,259 | 9/1976 | Harper, Jr. | 114/61 |
| 5,474,009 | 12/1995 | Ritchie et al. | 114/61 |
| 5,517,940 | 5/1996 | Beyer | 114/354 |

*Primary Examiner*—Ed Swinehart
*Attorney, Agent, or Firm*—Joseph N. Breaux

[57] ABSTRACT

An expandable pontoon boat that is retractable into a retracted configuration for trailering and expandable to provide additional passenger room. The expandable pontoon boat includes an interlock switch to prevent the expandable pontoon boat from being expanded when out of the water and includes center, left and right passenger hull shells supported on an expandable pontoon assembly.

1 Claim, 5 Drawing Sheets

EXPANDABLE PONTOON BOAT

TECHNICAL FIELD

The present invention relates to watercraft and more particularly to an expandable pontoon boat that is placed into a retracted configuration for trailering to a boating location and expandable, once afloat, to an expanded configuration providing a greater width passenger hull shell for enjoyment while boating on the water; the expandable pontoon boat including center, left and right passenger hull shells supported on an expandable pontoon assembly; the expandable pontoon assembly including a center fixed pontoon assembly supporting the center passenger hull shell, a left extendable pontoon assembly supporting the left passenger hull section and including three elongated rack gear members extending toward and in slidable connection with the center fixed pontoon assembly, a right extendable pontoon assembly supporting the right passenger hull section and including three elongated rack gear members extending toward and in slidable connection with the center fixed pontoon assembly, and a pontoon expansion/retraction control circuit; the center fixed pontoon assembly including a center pontoon member, a bi-directional drive motor, a drive shaft having three worm gear sections, a slip clutch assembly coupled between the bi-directional drive motor and the drive shaft, three left rack receiving guide tubes extending perpendicularly across the center pontoon, three right rack receiving guide tubes extending perpendicularly across the center pontoon, three rotating drive gear assemblies having a first gear meshed with one of the worm gears of the drive shaft and a drive pinion gear in driven connection with the first gear, and a float interlock switch attached to the center pontoon member at a location below a draft line of the center pontoon member; the left extendable pontoon assembly including a left pontoon member and the three elongated left rack gear members, each of the three elongated left rack gear members having a geared portion in enmeshed engagement with one of the drive pinion gears, an end length slidably supported within a corresponding left rack receiving guide tube, and an end stop on the far end thereof that is sized to prevent the far end of the end length from sliding into the rack receiving guide tube; the right extendable pontoon assembly including a right pontoon member and the three elongated right rack gear members each having a geared portion in enmeshed engagement with one of the drive pinion gears, an end length slidably supported within a corresponding right rack receiving guide tube, and an end stop on the far end thereof that is sized to prevent the far end of the end length from sliding into the rack receiving guide tube; the left rack gear members being forced to the left and the right rack gear members being forced to the right by rotation of the drive pinion gear in a first rotational direction; the left rack gear members being forced to the right and the right rack gear members being forced to the left by rotation of the drive pinion gear in a second rotational direction opposite the first rotational direction; the pontoon expansion/retraction control circuit including a two pole spring centered extend/retract selector switch, the shaft drive motor including forward and reverse control inputs each wired in connection with one of the two poles of the two pole spring centered extend/retract selector switch, and the float interlock switch wired in series with the shaft drive motor and the spring centered extend/retract selector switch; the float interlock switch being positioned on the center pontoon member in a manner such that the center pontoon member must be floating in water to close the float interlock switch and, thereby, enable operation of the shaft drive motor.

BACKGROUND ART

Pontoon boats are typically adapted as party boats for carrying a larger number of passengers than a conventional power boat. Because pontoon boats have a large passenger area, they are typically wide and difficult to trailer to and from boating locations. It would be a benefit, therefore, to have a pontoon boat that was retractable into a retracted configuration for trailering and expandable once in the water to provide additional passenger room.

GENERAL SUMMARY DISCUSSION OF INVENTION

It is an object of the invention to provide an expandable pontoon boat that is retractable into a retracted configuration for trailering and expandable to provide additional passenger room.

It is a further object of the invention to provide an expandable pontoon boat that includes an interlock switch to prevent the expandable pontoon boat from being expanded when out of the water.

It is a still further object of the invention to provide an expandable pontoon boat that includes center, left and right passenger hull shells supported on an expandable pontoon assembly; the expandable pontoon assembly including a center fixed pontoon assembly supporting the center passenger hull shell, a left extendable pontoon assembly supporting the left passenger hull section and including three elongated rack gear members extending toward and in slidable connection with the center fixed pontoon assembly, a right extendable pontoon assembly supporting the right passenger hull section and including three elongated rack gear members extending toward and in slidable connection with the center fixed pontoon assembly, and a pontoon expansion/retraction control circuit; the center fixed pontoon assembly including a center pontoon member, a bi-directional drive motor, a drive shaft having three worm gear sections, a slip clutch assembly coupled between the bi-directional drive motor and the drive shaft, three left rack receiving guide tubes extending perpendicularly across the center pontoon, three right rack receiving guide tubes extending perpendicularly across the center pontoon, three rotating drive gear assemblies having a first gear meshed with one of the worm gears of the drive shaft and a drive pinion gear in driven connection with the first gear, and a float interlock switch attached to the center pontoon member at a location below a draft line of the center pontoon member; the left extendable pontoon assembly including a left pontoon member and the three elongated left rack gear members, each of the three elongated left rack gear members having a geared portion in enmeshed engagement with one of the drive pinion gears, an end length slidably supported within a corresponding left rack receiving guide tube, and an end stop on the far end thereof that is sized to prevent the far end of the end length from sliding into the rack receiving guide tube; the right extendable pontoon assembly including a right pontoon member and the three elongated right rack gear members each having a geared portion in enmeshed engagement with one of the drive pinion gears, an end length slidably supported within a corresponding right rack receiving guide tube, and an end stop on the fair end thereof that is sized to prevent the far end of the end length from sliding into the rack receiving guide tube; the left rack gear members being forced to the left and the right rack gear members being forced to the right by rotation of the drive pinion gear in a first rotational direction; the left rack gear members being forced to the right and the right rack gear members being forced to the left by rotation of the drive pinion gear in a second rotational direction opposite the first rotational direction; the pontoon expansion/retraction control circuit including a two pole spring centered extend/retract selector switch, the shaft drive motor including forward and reverse control inputs each wired in connection with one of the two poles of the two pole spring centered extend/retract selector switch, and the float interlock switch wired in series with the shaft drive motor and the spring centered extend/retract selector switch; the float interlock switch being positioned on the center pontoon member in a manner such that the center pontoon member must be floating in water to close the float interlock switch and, thereby, enable operation of the shaft drive motor.

It is a still further object of the invention to provide an expandable pontoon boat that accomplishes all or some of the above objects in combination.

Accordingly, an expandable pontoon boat is provided. The expandable pontoon boat includes center, left and right passenger hull shells supported on an expandable pontoon assembly; the expandable pontoon assembly including a center fixed pontoon assembly supporting the center passenger hull shell, a left extendable pontoon assembly supporting the left passenger hull section and including three elongated rack gear members extending toward and in slidable connection with the center fixed pontoon assembly, a right extendable pontoon assembly supporting the right passenger null section and including three elongated rack gear members extending toward and in slidable connection with the center fixed pontoon assembly, and a pontoon expansion/retraction control circuit; the center fixed pontoon assembly including a center pontoon member, a bi-directional drive motor, a drive shaft having three worm gear sections, a slip clutch assembly coupled between the bi-directional drive motor and the drive shaft, three left rack receiving guide tubes extending perpendicularly across the center pontoon, three right rack receiving guides tubes extending perpendicularly across the center pontoon, three rotating drive gear assemblies having a first gear meshed wish one of the worm gears of the drive shaft and a drive pinion gear in driven connection with the first gear, and a float interlock switch attached to the center pontoon member at a location below a draft line of the center pontoon member; the left extendable pontoon assembly including a left pontoon member and the three elongated left rack gear members, each of the three elongated left rack gear members having a geared portion in enmeshed engagement with one of the drive pinion gears, an end length slidably supported within a corresponding left rack receiving guide tube, and an end stop on the far end thereof that is sized to prevent the far end of the end length from sliding into the rack receiving guide tube; the right extendable pontoon assembly including a right pontoon member and the three elongated right rack gear members each having a geared portion in enmeshed engagement with one of the drive pinion gears, an end length slidably supported within a corresponding right rack receiving guide tube, and an end stop on the far end thereof that is sized to prevent the far end of the end length from sliding into the rack receiving guide tube; the left rack gear members being forced to the left and the right rack gear members being forced to the right by rotation of the drive pinion gear in a first rotational direction; the left rack gear members being forced to the right and the right rack gear members being forced to the left by rotation of the drive pinion gear in a second rotational direction opposite the first rotational direction; the pontoon expansion/retraction control circuit including a two pole spring centered extend/retract selector switch, the shaft drive motor including forward and reverse control inputs each wired in connection with one of the two poles of the two pole spring centered extend/retract selector switch, and the float interlock switch wired in series with the shaft drive motor and the spring centered extend/retract selector switch; the float interlock switch being positioned on the center pontoon member in a manner such that the center pontoon member must be floating in water to close the float interlock switch and, thereby, enable operation of the shaft drive motor.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
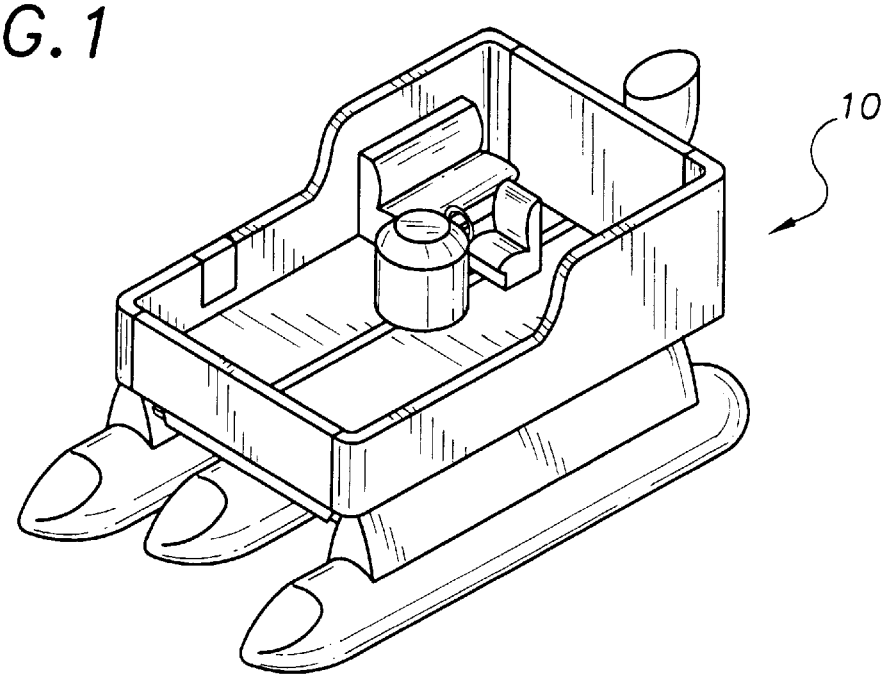
FIG. 1 is a perspective view of an exemplary embodiment of the expandable pontoon boat of the present invention in the retracted configuration.
Figure 2:
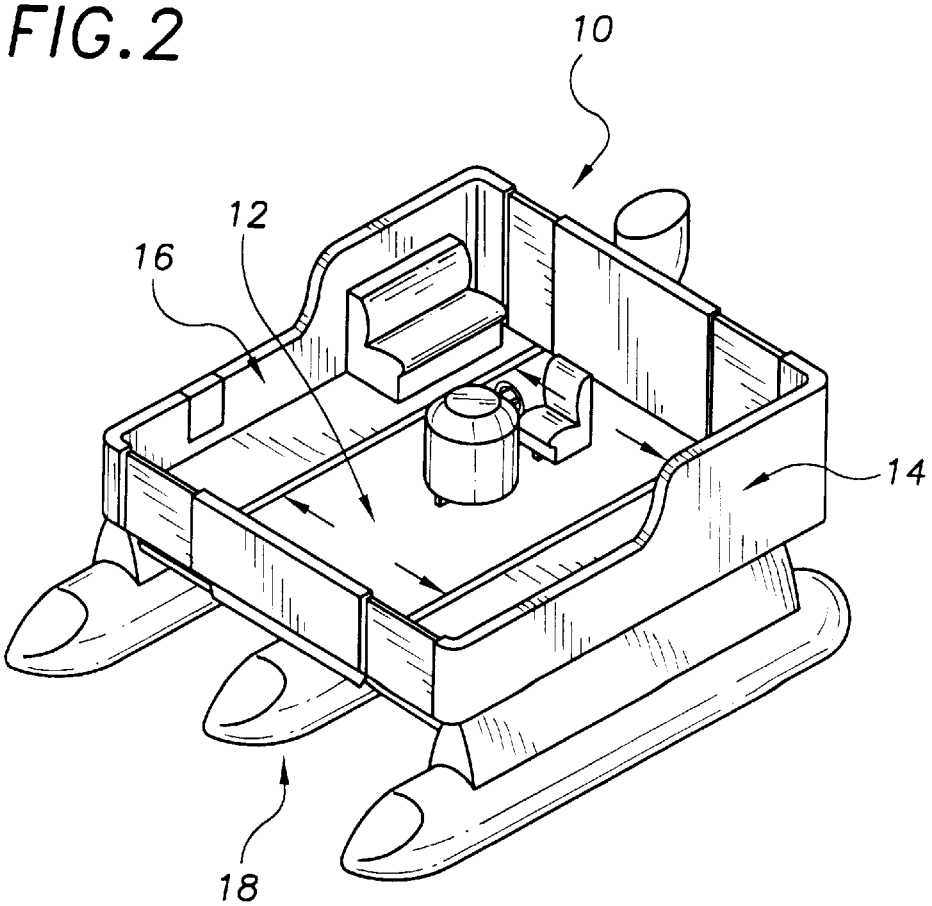
FIG. 2 is a perspective view of the exemplary expandable pontoon boat of FIG. 1 in the expanded configuration with the left and right extendable pontoon assemblies extended from the fixed center pontoon assembly.

FIG. 1 shows an exemplary embodiment of the expandable pontoon boat of the present invention, generally designated 10, in the retracted configuration used when pontoon boat 10 is to be trailered. FIG. 2 shows the exemplary expandable pontoon boat 10 of FIG. 1 in the expanded configuration used when on the water showing a center passenger hull shell section, generally designated 12; a left passenger hull shell section, generally designated 14; a right passenger hull shell section, generally designated 16; and an expandable pontoon assembly, generally designated 18. In this embodiment center passenger hull shell section 12, left passenger hull shell section 14 and right passenger hull shell section 16 are of fiberglass construction. Left passenger hull shell section 14 and right passenger hull shell section 16 are each slidable with respect to center passenger hull shell section 12.

Figure 3:
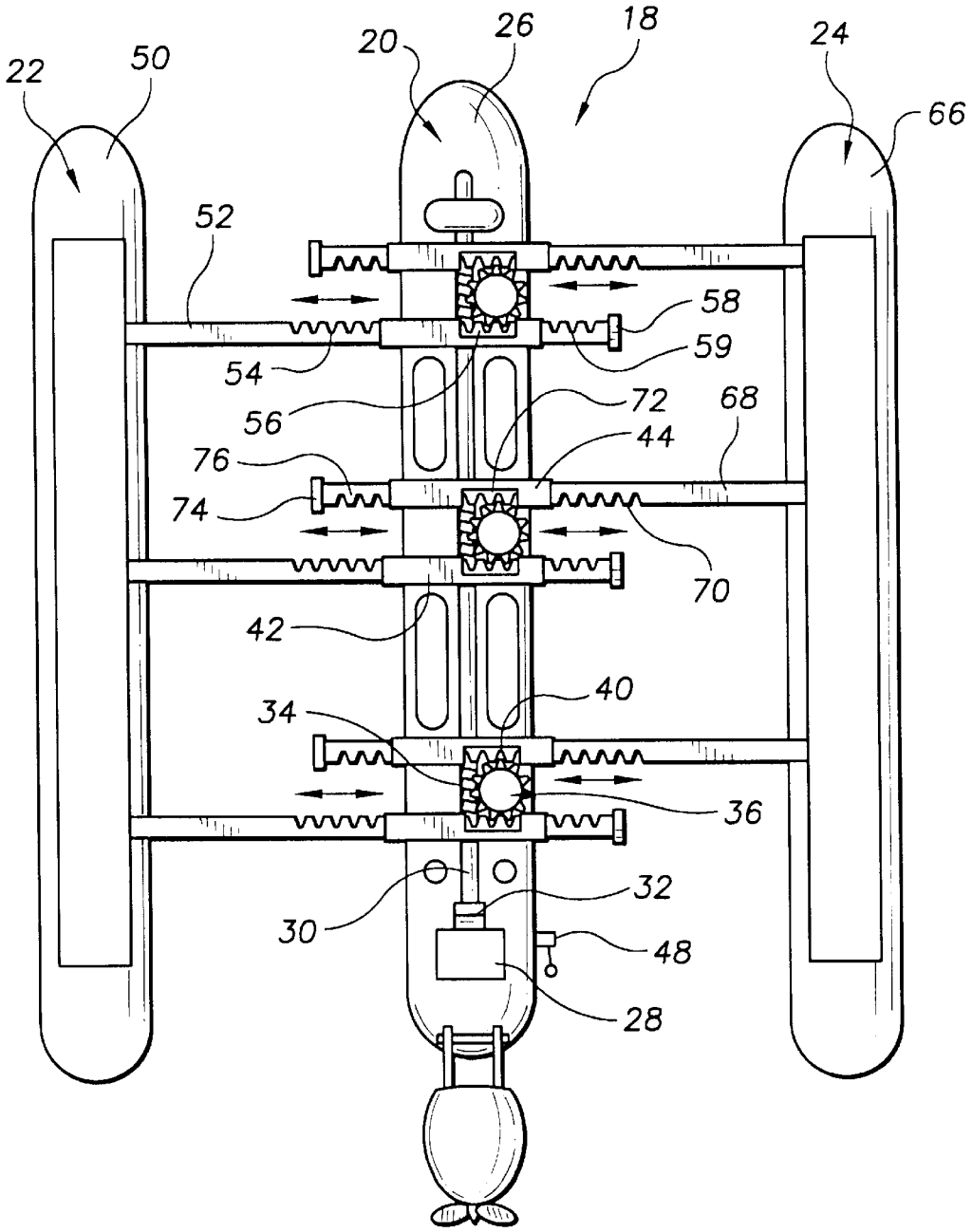
FIG. 3 is a top plan view of the expandable pontoon assembly of the expandable pontoon boat of FIG. 1 with the center, left and right passenger hull shell sections removed showing the center fixed pontoon assembly, the left extendable pontoon assembly including three elongated rack gear members extending toward and in slidable connection with the center fixed pontoon assembly and the right extendable pontoon assembly including three elongated rack gear members extending toward and in slidable connection with the center fixed pontoon assembly; the center fixed pontoon assembly including a center pontoon member, a drive motor attached to a drive shaft with a slip clutch assembly, the drive shaft having three worm gear sections, three left rack receiving guide tubes extending perpendicularly across the center pontoon, three right rack receiving guide tubes extending perpendicularly across the center pontoon, three rotating drive gear assemblies having a first gear meshed with one of the worm gears of the drive shaft and a drive pinion gear in driven connection with the first gear, and a float interlock switch attached to the center pontoon member at a location below the draft line of the center pontoon member; the left extendable pontoon assembly including a left pontoon member and the three elongated left rack gear members each having a geared portion in enmeshed engagement with one of the drive pinion gears, an end length slidably supported within a corresponding left rack receiving guide tube, and an end stop on the far end thereof that is sized to prevent the far end of the end length from sliding into the rack receiving guide tube; the right extendable pontoon assembly including a right pontoon member and the three elongated right rack gear members each having a geared portion in enmeshed engagement with one of the drive pinion gears, an end length slidably supported within a corresponding right rack receiving guide tube, and an end stop on the far end thereof that is sized to prevent the far end of the end length from sliding into the rack receiving guide tube; the left rack gear members being forced to the left and the right rack gear members being forced to the right by rotation of the drive pinion gear in a first rotational direction; the left rack gear members being forced to the right and the right rack gear members being forced to the left by rotation of the drive pinion gear in a second rotational direction opposite the first rotational direction.

Referring now to FIG. 3, expandable pontoon assembly 18 includes a center fixed pontoon assembly, generally designated 20; a left extendable pontoon assembly, generally designated 22; and a right extendable pontoon assembly 24. Center fixed pontoon assembly 20 includes a center pontoon member 26 and a bi-directional, electric drive motor 28 attached to a drive shaft 30 with a slip clutch assembly 32. Drive shaft 30 has three worm gear sections 34 spaced therealong that are in driving connection with, respectively, three rotating drive gear assemblies, each generally designated 36. Each rotating drive gear assembly 36 has a first gear meshed with one of the worm gear sections 34 of drive shaft 32 and a drive pinion gear 40.

Center pontoon assembly 20 also includes three left rack receiving guide tubes 42 extending perpendicularly across center pontoon member 26; three right rack receiving guide tubes 44 extending perpendicularly across center pontoon member 26; and a float interlock switch 48 attached to center pontoon member 26 at a location below the draft line of the center pontoon member 26 so that float interlock switch 48 is forced into the closed state by the water in which center pontoon member 26 is floating.

Left extendable pontoon assembly 22 includes a left pontoon member 50; three elongated left rack gear members 52, each having a geared portion 54 in enmeshed engagement with a drive pinion gear 40, an end length 56 slidably positioned within a left rack receiving guide tube 42; and an end stop 58 on the far end 59 thereof that is sized to prevent the far end 59 of end length 56 from sliding into and through rack receiving guide tube 42.

Figure 5:
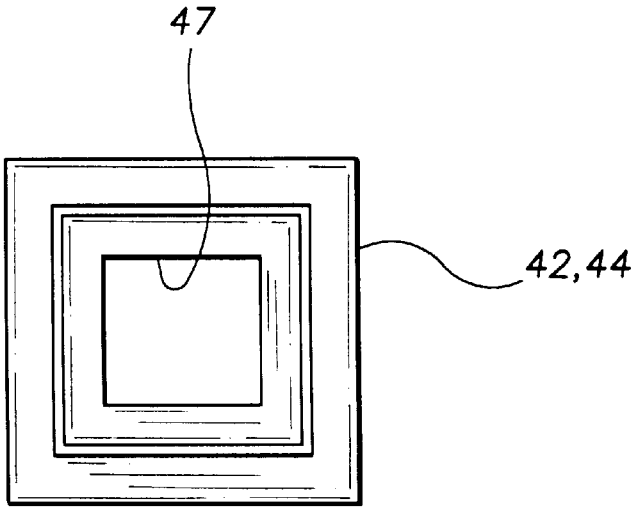
FIG. 5 is a plan end view showing a nylon bushing bearing installed within one of the rack receiving guide tubes.

Right extendable pontoon assembly 24 includes a right pontoon member 66; three elongated right rack gear members 68, each having a geared portion 70 in enmeshed engagement with a drive pinion gear 40 and an end length 72 slidably supported within a corresponding right rack receiving guide tube 44; and an end stop 74 on the far end 76 thereof that is sized to prevent far end 76 of on the far end thereof that is sized to prevent the far end 76 of end length 72 from sliding into and through rack receiving guide tube 44. End stops 58 and 74 operate in conjunction with slip clutch assembly 32 to determine the farthest most extension of left and right extendable pontoon assemblies 22,24. Each of the left and right rack receiving guide tubes 42,44 has a nylon bushing bearing 47 (FIG. 5) fit therein for reducing the friction between rack receiving guide tubes 42,44 and left and right left rack gear members 52,68, respectively.

In use, left rack gear members 52 are forced to the left and right rack gear members 68 are forced to the right by rotation of the drive pinion gears 40 in the clockwise rotational direction. Left rack gear members 52 are forced to the right and right rack gear members 68 are forced to the left by rotation of the drive pinion gears 40 in the counter clockwise rotational direction.

Figure 4:
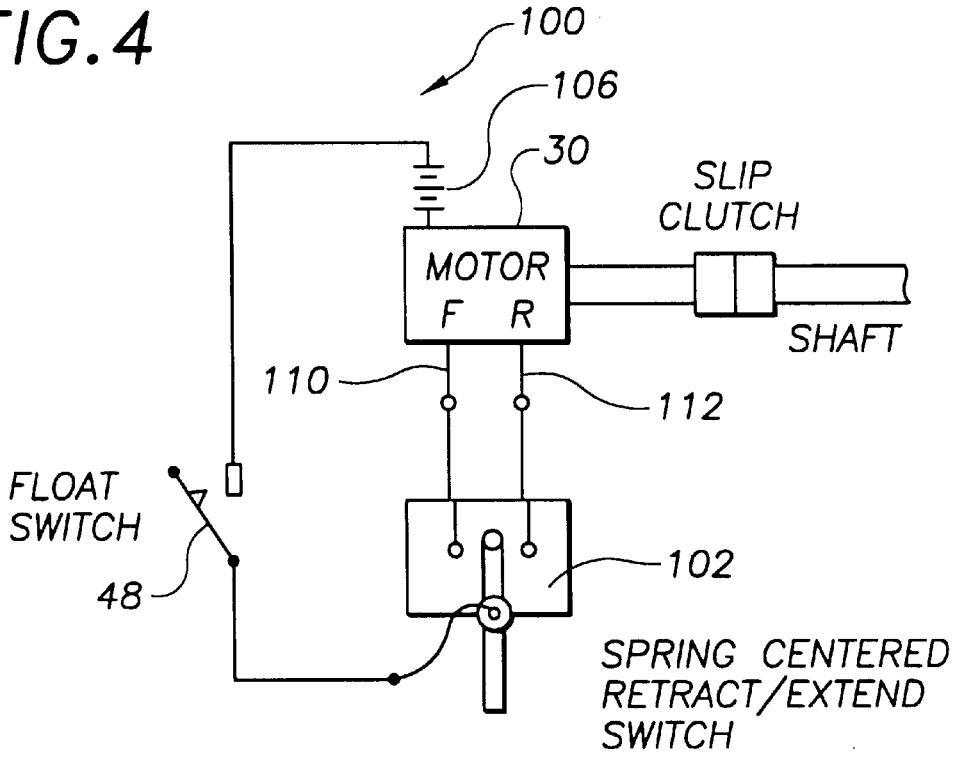
FIG. 4 is a schematic diagram showing the pontoon expansion/retraction control circuit including the two pole spring centered extend/retract selector switch, the shaft drive motor including the forward and reverse control inputs each wired in connection with one of the two poles of the two pole spring centered extend/retract selector switch, and the float interlock switch wired in series with the shaft drive motor and the spring centered extend/retract selector switch.

With reference to FIG. 4, expansion and retraction of left and right extendable pontoon assemblies 22,24 (FIG. 2) is controlled by a pontoon expansion/retraction control circuit, generally designated 100. Pontoon expansion/retraction control circuit 100 includes a spring centered, two pole, extend/retract selector switch 102, shaft drive motor 30, float interlock switch 48, and boat battery 106. Shaft drive motor 30 includes a forward control input 110 and a reverse control input 112 that are, respectively electrically connected to first and second poles 114,116 of spring centered, two pole, extend/retract selector switch 102.

Figure 6:
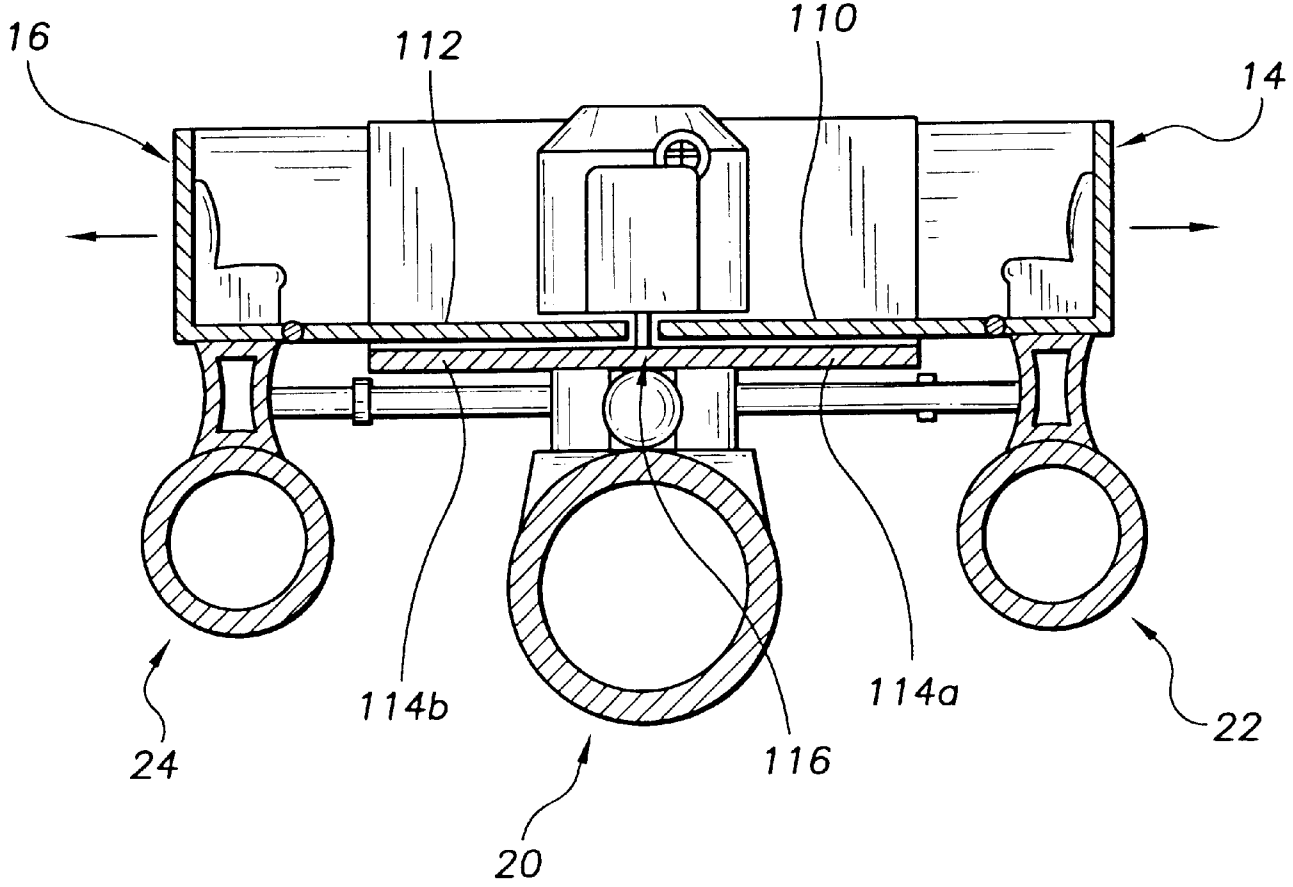
FIG. 6 is a partial cross sectional view of the expandable pontoon boat of FIG. 1 in the retracted configuration showing the left extendable pontoon assembly and the right extendable pontoon assembly fully retracted toward the center pontoon assembly with the hingedly attached left and right floor sections of the left and right hull shell sections positioned over and supported on the left and right side portions of the center floor section of the center hull shell section.

FIG. 6 shows left extendable pontoon assembly 22 and right extendable pontoon assembly 24 retracted with left and right passenger hull shell floors 110,112 positioned over and supported by left and right sides 114*a*,114*b* of a center passenger hull floor, generally designated 116, of center pontoon assembly 20. Left and right passenger hull shell floors 110,112 are each hingedly attached to its respective left and right passenger hull shell section 14,16.

Figure 7:
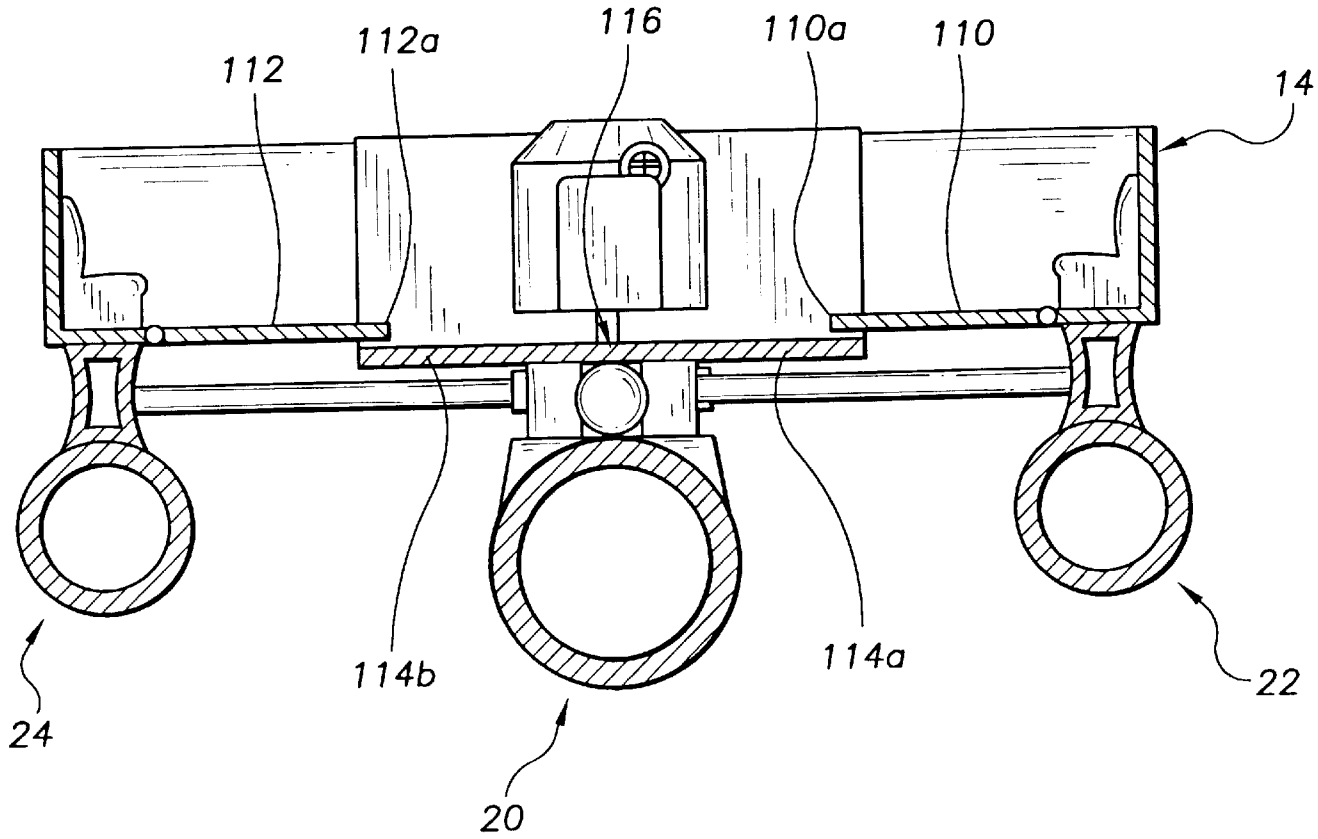
FIG. 7 is a partial cross sectional view of the expandable pontoon boat of FIG. 1 in the extended configuration showing the left extendable pontoon assembly and the right extendable pontoon assembly fully extended to the right and left of the center pontoon assembly and the end portions of the left and right floor sections supported on the center floor section.

FIG. 7 shows left extendable pontoon assembly 22 and right extendable pontoon assembly 24 fully extended to the right and left 20 of center fixed pontoon assembly 20 with the edges 110*a*,112*a* of left and right passenger hull shell floor sections 110,112 supported on the left and ride sides 114*a*,114*b* of center passenger hull floor 116.

It can be seen from the preceding description that an expandable pontoon boat has been provided that is retractable into a retracted configuration for trailering and expandable to provide additional passenger room; that includes an interlock switch to prevent the expandable pontoon boat from being expanded when out of the water; and that includes center, left and right passenger hull shells supported on an expandable pontoon assembly; the expandable pontoon assembly including a center fixed pontoon assembly supporting the center passenger hull shell, a left extendable pontoon assembly supporting the left passenger hull section and including three elongated rack gear members extending toward and in slidable connection with the center fixed pontoon assembly, a right extendable pontoon assembly supporting the right passenger hull section and including three elongated rack gear members extending toward and in slidable connection with the center fixed pontoon assembly, and a pontoon expansion/retraction control circuit; the center fixed pontoon assembly including a center pontoon member, a bi-directional drive motor, a drive shaft having three worm gear sections, a slip clutch assembly coupled between the bi-directional drive motor and the drive shaft, three left rack receiving guide tubes extending perpendicularly across the center pontoon, three right rack receiving guide tubes extending perpendicularly across the center pontoon, three rotating drive gear assemblies having a first gear meshed with one of the worm gears of the drive shaft and a drive pinion gear in driven connection with the first gear, and a float interlock switch attached to the center pontoon member at a location below a draft line of the center pontoon member; the left extendable pontoon assembly including a left pontoon member and the three elongated left rack gear members, each of the three elongated left rack gear members having a geared portion in enmeshed engagement with one of the drive pinion gears, an end length slidably supported within a corresponding left rack receiving guide tube, and an end stop on the fear end thereof that is sized to prevent the far end of the end length from sliding into the rack receiving guide tube; the right extendable pontoon assembly including a right pontoon member and the three elongated right rack gear members each having a geared portion in enmeshed engagement with one of the drive pinion gears, an end length slidably supported within a corresponding right rack receiving guide tube, and an end stop on the far end thereof that is sized to prevent the far end of the end length from sliding into the rack receiving guide tube; the left rack gear members being forced to the left and the right rack gear members being forced to the right by rotation of the drive pinion gear in a first rotational direction; the left rack gear members being forced to the right and the right rack gear members being forced to the left by rotation of the drive pinion gear in a second rotational direction opposite the first rotational direction; the pontoon expansion/retraction control circuit including a two pole spring centered extend/retract selector switch, the shaft drive motor including forward and reverse control inputs each wired in connection with one of the two poles of the two pole spring entered extend/retract selector switch, and the float interlock switch wired in series with the shaft drive motor and the spring centered extend/retract selector switch; the float interlock switch being positioned on the center pontoon member in a manner such that the center pontoon member must be floating in water to close the float interlock switch and, thereby, enable operation of the shaft drive motor.

It is noted that the embodiment of the expandable pontoon boat described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An expandable pontoon boat comprising:

a center passenger hull shell;

a left passenger hull shell;

a right passenger hull shell; and an expandable pontoon assembly including a center fixed pontoon assembly supporting said center passenger hull shell, a left extendable pontoon assembly supporting said left passenger hull section and including three elongated rack gear members extending toward and in slidable connection with said center fixed pontoon assembly, a right extendable pontoon assembly supporting said right passenger hull section and including three elongated rack gear members extending toward and in slidable connection with said center fixed pontoon assembly, and a pontoon expansion/retraction control circuit;

said center fixed pontoon assembly including a center pontoon member, a bi-directional drive motor, a drive shaft having three worm gear sections, a slip clutch assembly coupled between said bi-directional drive motor and said drive shaft, three left rack receiving guide tubes extending perpendicularly across said center pontoon member, three right rack receiving guide tubes extending perpendicularly across said center pontoon member, three rotating drive gear assemblies having a first gear meshed with one of said worm gear sections of said drive shaft and a drive pinion gear in driven connection with said first gear, and a float interlock switch attached to said center pontoon member at a location below a draft line of said center pontoon member;

said left extendable pontoon assembly including a left pontoon member and said three elongated left rack gear members, each of said three elongated left rack gear members having a geared portion in enmeshed engagement with one of said drive pinion gears, an end length slidably supported within a corresponding left rack receiving guide tube, and an end stop on said far end thereof that is sized to prevent said far end of said end length from sliding into said rack receiving guide tube;

said right extendable pontoon assembly including a right pontoon member and said three elongated right rack gear members each having a geared portion in enmeshed engagement with one of said drive pinion gears, an end length slidably supported within a corresponding right rack receiving guide tube, and an end stop on said far end thereof that is sized to prevent said far end of said end length from sliding into said rack receiving guide tube;

said left rack gear members being forced to said left and said right rack gear members being forced to said right by rotation of said drive pinion gear in a first rotational direction;

said left rack gear members being forced to said right and said right rack gear members being forced to said left by rotation of said drive pinion gear in a second rotational direction opposite said first rotational direction;

said pontoon expansion/retraction control circuit including a two pole spring centered extend/retract selector switch, said shaft drive motor including forward and reverse control inputs each wired in connection with one of said two poles of said two pole spring centered extend/retract selector switch, and said float interlock switch wired in series with said shaft drive motor and said spring centered extend/retract selector switch;

said float interlock switch being positioned on said center pontoon member in a manner such that said center pontoon member must be floating in water to close said float interlock switch and, thereby, enable operation of said shaft drive motor.

* * * * *